US012344994B2

(12) United States Patent
Vogel et al.

(10) Patent No.: US 12,344,994 B2
(45) Date of Patent: Jul. 1, 2025

(54) ADJUSTING A HIGH PRESSURE FEEDER BASED ON FLUID LEAKAGE

(71) Applicant: Andritz Inc., Alpharetta, GA (US)

(72) Inventors: Keith Vogel, Queensbury, NY (US); Tyson B. Hunt, Saratoga Springs, NY (US); Blake Whiteside, Trussville, AL (US); Carlton L. Luhrmann, Alpharetta, GA (US); Scott A. Pope, Atlanta, GA (US); Aaron Leavitt, Alpharetta, GA (US)

(73) Assignee: ANDRITZ INC., Alpharetta, GA (US)

( * ) Notice: Subject to any disclaimer, the term of this patent is extended or adjusted under 35 U.S.C. 154(b) by 328 days.

(21) Appl. No.: 17/801,124

(22) PCT Filed: Mar. 3, 2021

(86) PCT No.: PCT/US2021/020669
§ 371 (c)(1),
(2) Date: Aug. 19, 2022

(87) PCT Pub. No.: WO2021/178538
PCT Pub. Date: Sep. 10, 2021

(65) Prior Publication Data

US 2023/0081586 A1 Mar. 16, 2023

Related U.S. Application Data

(60) Provisional application No. 62/984,568, filed on Mar. 3, 2020.

(51) Int. Cl.
*D21C 3/22* (2006.01)
*D21C 7/00* (2006.01)

(52) U.S. Cl.
CPC ..... *D21C 3/22* (2013.01); *D21C 7/00* (2013.01)

(58) Field of Classification Search
CPC ..... D21C 3/22; D21C 7/00
See application file for complete search history.

(56) References Cited

U.S. PATENT DOCUMENTS 5,443,162 A 8/1995 Sherman
5,622,598 A 4/1997 Prough
(Continued)

FOREIGN PATENT DOCUMENTS

SU 1087588 A1 4/1984
SU 1294893 A1 3/1987

OTHER PUBLICATIONS

International Preliminary Report on Patentability in International Appln. No. PCT/US2021/020669, mailed on Sep. 15, 2022, 6 pages.
(Continued)

*Primary Examiner* — Abbas Rashid
*Assistant Examiner* — Elisa H Vera
(74) *Attorney, Agent, or Firm* — Myers Bigel, P.A.

(57) ABSTRACT

Methods, systems, and apparatus, including computer programs encoded on a computer storage medium, that adjust a high-pressure feeder of a feed system used in pulp production based on the fluid leakage through a low-pressure outlet of a high-pressure feeder. Methods can include obtaining multiple flow values, including (1) a make-up liquor flow value, (2) a black liquor flow value, (3) a white liquor flow value, (4) a chip chute circulation flow value, and (5) a high pressure feeder purge flow value. Methods can include determining a chip flow value specifying a flow of chips provided to the high-pressure feeder. Based on the flow values, methods can determine a fluid leakage value specifying an amount of fluid leakage through a gap between a pocket rotor and the housing of the high pressure feeder. Methods can adjust an annular gap based on the fluid leakage value satisfies a threshold leakage value.

12 Claims, 7 Drawing Sheets

(56) References Cited

U.S. PATENT DOCUMENTS

| | | | | |
|---|---|---|---|---|
| 6,669,410 | B2 | 12/2003 | Prough | |
| 7,845,516 | B2 | 12/2010 | Pessin et al. | |
| 2009/0142147 | A1 | 6/2009 | Pope et al. | |
| 2017/0175328 | A1* | 6/2017 | Hunt | D21C 3/02 |

OTHER PUBLICATIONS

International Search Report and Written Opinion in International Appln. No. PCT/US2021/020669, mailed on May 26, 2021, 7 pages.
"Official Action" and English language translation, RU Application No. 2022125551, Jun. 28, 2024, 19 pp.
"Notice of Reasons for Rejection and English language translation", JP Application No. 2022-553054, Jan. 21, 2025, 12 pp.

* cited by examiner

ADJUSTING A HIGH PRESSURE FEEDER BASED ON FLUID LEAKAGE

CLAIM OF PRIORITY

This application is a U.S. National Stage Application of International Application No. PCT/US2021/020669, filed on Mar. 3, 2021, which claims the benefit of U.S. Provisional Patent Application Ser. No. 62/984,568, filed on Mar. 3, 2020. The entire content of the foregoing applications are hereby incorporated by reference.

CLAIM OF PRIORITY

This application claims the benefit of U.S. Provisional Patent Application Ser. No. 62/984,568, filed on Mar. 3, 2020. The entire content of the foregoing application is hereby incorporated by reference.

BACKGROUND

This specification generally relates to adjusting a high-pressure feeder of a feed system used in pulp production based on the fluid leakage from the high-pressure side to the low-pressure side of a high-pressure feeder.

In a feed system that is used for pulp production, wood chips (or other cellulosic material) are generally fed to a treatment vessel, such as a digester, which uses wood chips in producing cellulosic pulp. A high-pressure feeder (HPF) is a component of this feed system that transfers wood chips and circulation liquor (as further described in this specification) from a low-pressure portion of the system to a high-pressure portion of the system. In general, the HPF pressurizes the low-pressure feed of wood chips and circulation liquor (e.g., arriving at about 20-25 psig) that it receives and outputs the resulting chip slurry at a substantially higher pressure (e.g., of about 200-250 psig) to a digester. The HPF is a critical component of the feed system because, without it, the high-pressure portion of the system does not receive any high-pressure feed of chips and liquor, which in turn results in complete cessation of any pulp production.

Like other mechanical components, a HPF generally degrades with use over time. When a HPF degrades and/or begins to degrade, there may be increased or decreased fluid leakage through a low-pressure outlet of the HPF. An increase in fluid leakage may result in a loss in pressure of the chip slurry provided to the digester. A decrease in fluid leakage, on the other hand, may result in limited or no lubrication over particular components of the HPF (such as the pocket rotor and/or the chamber), causing metal-to-metal contact. This in turn can result in faster degradation of the HPF. Without adequate and/or routine maintenance and adjustments, an HPF can ultimately fail, causing the pulp production to cease until the HPF can be repaired and restored to service.

SUMMARY

In general, one innovative aspect of the subject matter described in this specification can be embodied in methods that can include the operations for controlling fluid leakage in a high pressure feeder of a feed system, including: obtaining, from a plurality of flow meters, a plurality of flow values, including (1) a make-up liquor flow value specifying a flow of make-up liquor to a digester, (2) a black liquor flow value specifying a flow of black liquor to the feed system, (3) a white liquor flow value specifying a flow of white liquor to the feed system, (4) a chip chute circulation flow value specifying a flow of low pressure circulation liquor from a low-pressure outlet of the high pressure feeder, and (5) a high pressure feeder purge flow value specifying a flow of white liquor into a high-pressure inlet of the high pressure feeder; obtaining, using a chip speed encoder, a chip speed specifying a speed at which wood chips are provided to the high-pressure feeder; determining, using the chip speed, a chip flow value specifying a flow of chips provided to the high-pressure feeder; determining, using the plurality of flow values and the chip flow value, a fluid leakage value specifying an amount of fluid leakage through a gap between a pocket rotor and a chamber of the high pressure feeder; determining that the fluid leakage satisfies a threshold leakage value; and in response to determining that the fluid leakage satisfies the threshold leakage value, adjusting the annular gap between the pocket rotor and the housing. Other embodiments of this aspect include corresponding systems, apparatus, and computer programs, configured to perform the actions of the methods, encoded on computer storage devices.

These and other embodiments can each optionally include one or more of the following features.

In some implementations, determining, using the plurality of flow values and the chip flow value, a fluid leakage value, can include computing a sum of the black liquor flow value, the white liquor flow value, the chip chute circulation flow value, and the high pressure feeder purge flow value; and reducing the make-up liquor flow value by the computed sum to obtain the fluid leakage value.

In some implementations, adjusting the annular gap between the pocket rotor and the housing includes moving the pocket rotor into the housing.

In some implementations, moving the pocket rotor into the housing can include moving the pocket rotor axially with respect to the housing and the methods can further include the pocket rotor being coaxial with the housing.

In some implementations, determining the chip flow value specifying a flow of chips provided to the high-pressure feeder, can include scaling the chip meter speed by (1) a volumetric capacity of wood chips specifying a volume of wood chips that are provided to the high pressure feeder at the chip speed and (2) a displacement value specifying a rate at which air is displaced from the wood chips provided to the high pressure feeder.

Particular embodiments of the subject matter described in this specification can be implemented to realize one or more of the following advantages. The innovations described in this specification can determine appropriate adjustments to a high-pressure feeder in a feed system based on the fluid leakage through the low-pressure outlet of the HPF. By applying the appropriate adjustments to the HPF, the techniques described in this specification can extend the operational life and/or stability of the HPF and thus, avoid any unexpected or untimely defects and/or failures of the HPF. Extending the operational period between maintenance and repair of HPFs can also reduce potential interruptions in pulp production and thus enables continued pulp production by the digester.

Moreover, the techniques described in this specification result in better control of the fluid leakage through the HPF. This not only results in improved operation stability of the HPF, but also reduces the load on downstream equipment, which in turn results in better performance of the other controls and processing equipment in the system. Thus, by enabling better control over the fluid leakage, the techniques described in this specification can result in longer lifetime of equipment, valves, etc. and/or improved production capacity of the overall system.

The techniques described in this specification can also accurately determine the amount of fluid leakage through the low-pressure outlet of the HPF (as further described in this specification), which is used to determine the specific amount of adjustment to apply to the HPF. Conventional techniques for determining fluid leakage can be imprecise. For example, one conventional technique determines a rate of fluid leakage based on changes in a ratio of make-up liquor flow to chip flow. However, this conventional technique does not determine the precise amount of fluid leakage and thus, any resulting adjustment of the HPF based on this imprecise measure of increase/decrease in fluid leakage is similarly imprecise. Other conventional technique aimed to estimate fluid leakage by approximating a difference between flow through a high-pressure outlet of the HPF and sum of the flows into the HPF. In the absence of actual measured data, such conventional techniques could not accurately and precisely determine the fluid leakage. As a result, these and other conventional techniques lack the precision and accuracy of the techniques described in this specification, and they also do not extend the operational life of the HPF to the same extent (e.g., to the same precision) as the techniques described in this specification. Thus, the techniques discussed in this specification provide advantages over conventional techniques.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This document relates to techniques for adjusting a high-pressure feeder of a feed system used in pulp production based on the fluid leakage from the high-pressure side to the low-pressure side of a high-pressure feeder, e.g., via the annular area between the rotor and the housing As further described throughout this specification, a controller determines the fluid leakage through the low-pressure outlet of the high-pressure feeder. The controller determines the fluid leakage based on the flow of fluids throughout the feed system. In some implementations, the controller obtains (1) using a chip speed encoder, a chip flow to the high-pressure feeder and (2) using multiple flow meters, the make-up liquor flow to the digester, the black liquor flow to the feed system, the white liquor flow to the feed system, the chip chute circulation flow from a low-pressure outlet of the high pressure feeder, and (5) a high pressure feeder purge flow into a high-pressure inlet of the high pressure feeder. The controller determines the fluid leakage based on these flow values. In some implementations, the controller can determine the fluid leakage by computing a difference between the make-up liquor flow and a sum of the white liquor flow, the black liquor flow, the chip chute circulation flow, and the high-pressure feeder purge flow.

The controller uses the determined fluid leakage value in adjusting the high-pressure feeder. In some implementations, the controller determines whether the fluid leakage value satisfies (e.g., exceeds or is less than) a threshold leakage value. If the controller determines that the fluid leakage satisfies (e.g., exceeds) the threshold leakage value, the controller adjusts (e.g., reduces) an annular graph (e.g., the width of the gap) between the pocket rotor and the chamber of the high-pressure feeder. On the other hand, if the controller determines that the fluid leakage does not satisfy (e.g., is less than) the threshold leakage value, the controller 240 adjusts (e.g., increases) the annular gap between the pocket rotor 204 and the chamber 206.

These and other features are more fully described in the descriptions below.

Figure 1:
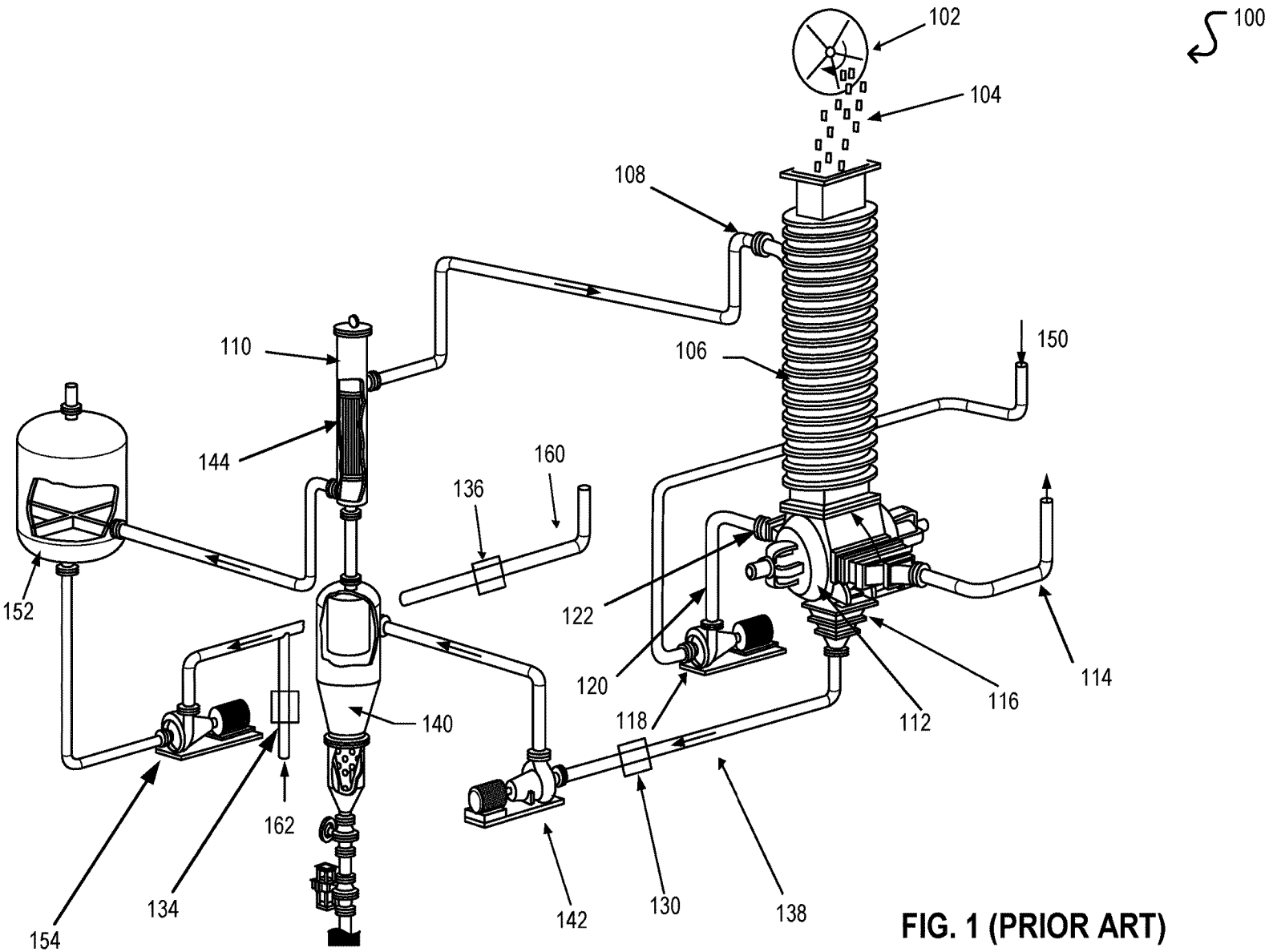
FIG. 1 (PRIOR ART)
FIG. 1 is a schematic diagram of a portion of a conventional feed system used in pulp and paper processing.

FIG. 1 is a schematic diagram of a portion of a conventional feed system 100 used in pulp and paper processing.

As part of the feed system 100, wood chips 104 from a chip bin or another chip supply system are provided by a rotary chip meter with a speed encoder 102 to a chip chute 106. At the same time that the chips 104 are being provided to the chip chute 106, circulation liquor (which can include, e.g., white and/or black liquor) liquor is input at a low pressure (e.g., at about 18-20 PSIG) to the chip chute 106 via the conduit 108. The circulation liquor is fed into the feed system 110 via conduit 162.

A flow meter 134 (e.g., a magnetic flow meter) located in/on/around the conduit 134 measures the fluid flow (e.g., in gallons per minute or another appropriate unit) of the white liquor. Similarly, black liquor, which is also used during the operation of the feed system, is input to the feed system 100, and a flow meter (e.g., a magnetic flow meter) located in/on/around the conduit through which the black liquor passes measures the fluid flow (e.g., in gallons per minute or another appropriate unit) of the black liquor.

The combination of the circulation liquor and the wood chips 104 (also referred to as chip slurry) passes through the chip chute 106 toward a high-pressure feeder (HPF) 112. The chip slurry travels to the HPF 112 at a pressure of about 18-25 PSIG. After passing through the HPF 112, the chip slurry (or a portion thereof) travels at a relatively higher pressure, e.g., of about 225 PSIG. The high-pressure slurry is suitable for introduction into a continuous digester, chip-steaming vessel, and other high-pressure chip processing systems.

The high-pressure slurry travels via a high-pressure conduit 114 to an inlet of a top separator of a digester (not shown in FIG. 1). At the digester, some or all of the excess circulation liquor in the slurry is separated from the chip slurry by a liquor separator and returned via conduit 150 to a pump 118. The pump 118 pressurizes the circulation liquor in conduit 150 and feeds it at high pressure through conduit 120 to a high-pressure inlet 122 of the HPF 112. This resulting high-pressure circulation liquor flows (also referred to as high pressure feeder purge flow) into the HPF 112 and pressurizes the chip slurry from the chip chute 106 such that the chip slurry exits the HPF at a high pressure into conduit 114. A flow meter (e.g., a magnetic flow meter), which is referred to as the high pressure purge flow meter, disposed at or near the HPF 112 or the high-pressure inlet 122, measures the fluid flow (e.g., in gallons per minute or another appropriate unit) of the high pressure feeder purge flow.

The HPF 112 also has a low-pressure outlet 116 from which a liquid is discharged. The liquid flowing through the low-pressure outlet 116 is the low-pressure circulation flow (which is also referred to as the chip chute circulation flow). A flow meter 130 (e.g., a magnetic flow meter), which is also referred to as a chip chute circulation flow meter 130, located in or around the conduit 138 measures the fluid flow (e.g., in gallons per minute or another appropriate unit) of the low pressure circulation (i.e., the chip chute circulation flow).

This low-pressure circulation flow passes via the conduit 138 and a pump 142 to a separator 140 (e.g., a sand separator), which isolates undesirable material and debris, such as sand, stones, etc., from the liquid. The resulting liquid (which generally includes circulation liquor and potentially small wood chips) discharged from the separator 140 has little or no undesirable material or debris and is passed through a liquor separator 144 (e.g., such as an in-line drainer). The liquor separator 144 separates the circulation liquor with potential small chips and at least some liquid from the resulting liquid discharged from the separator 140. The resulting circulation liquor is provided via the conduit 108 to the chip chute 106. The other liquid separated by the liquor separator 144 is sent via a conduit to a level tank 152. The level tank 152 in turn discharges some liquid that is supplied via a conduit to a make-up liquor pump 154, which in turn discharges make-up liquor. A flow meter 136 (e.g., a magnetic flow meter), which is referred to as the make-up liquor flow meter 136, on/in/around the conduit 160 measures the fluid flow (e.g., in gallons per minute or another appropriate unit) of the make-up liquor. The make-up liquor is supplied to the digester via conduit 160.

Figure 2:
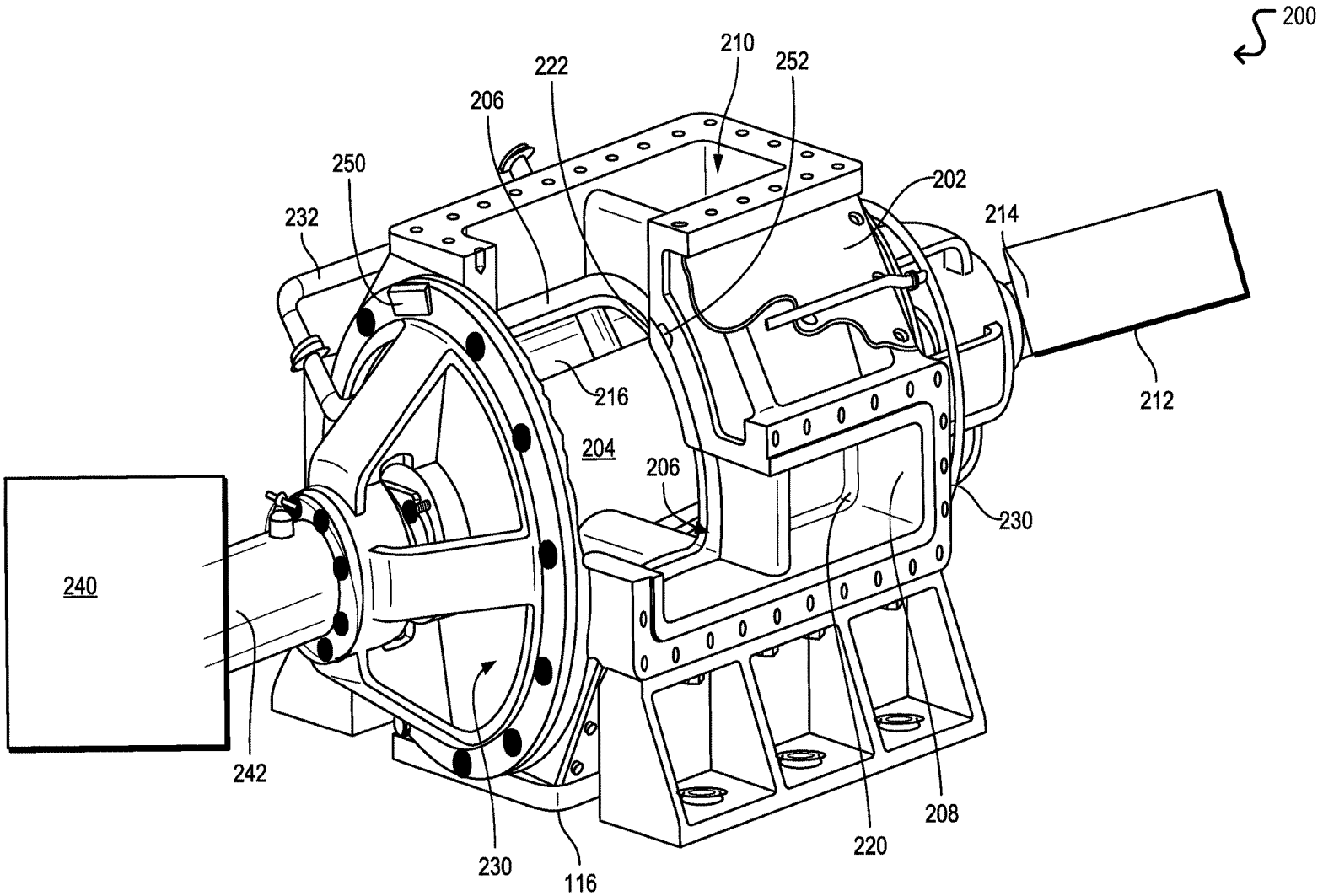
FIG. 2 is a perspective view of the high pressure feeder of FIG. 1.

FIG. 2 is a perspective view of the HPF 112 of FIG. 1.

The HPF 112 includes a stationary housing 202 with a pocketed cylindrical rotor (also referred to as the pocket rotor) 204 mounted for rotation in a tapered cylindrical chamber 206 of the housing. The housing includes four ports: a high-pressure inlet 122 (in rear of housing and show in FIG. 1); a high-pressure outlet 208; a low-pressure inlet 210 and a low-pressure outlet 116 (in bottom of housing and as shown in FIG. 1). The low-pressure inlet 210 is opposite on the housing to the low-pressure outlet 116, and the high-pressure inlet 122 is opposite on the housing to the high-pressure outlet 208.

The pocket rotor 204 is driven by a variable speed motor and gear reducer 212 coupled to a drive shaft 214. The pocket rotor 204 is driven to rotate in the housing chamber 202, such that the through-going pockets 216 of the rotor sequentially communicate with the four inlets/outlet ports of the housing.

The pocket rotor 204 contains two or more through-going pockets 216 (as shown further in FIG. 3) such that the different pockets communicate with different high and low-pressure inlets/outlets as the rotor rotates. Each pocket in the rotor defines a passage through the rotor with openings on opposite sides of the passage. The rotor can rotate at a speed between about five to fifteen revolutions per minute (rpm) or, preferably, between about seven to ten rpm, depending upon the capacity of the HPF and the production rate of the pulping system it is used to feed.

Figure 3:
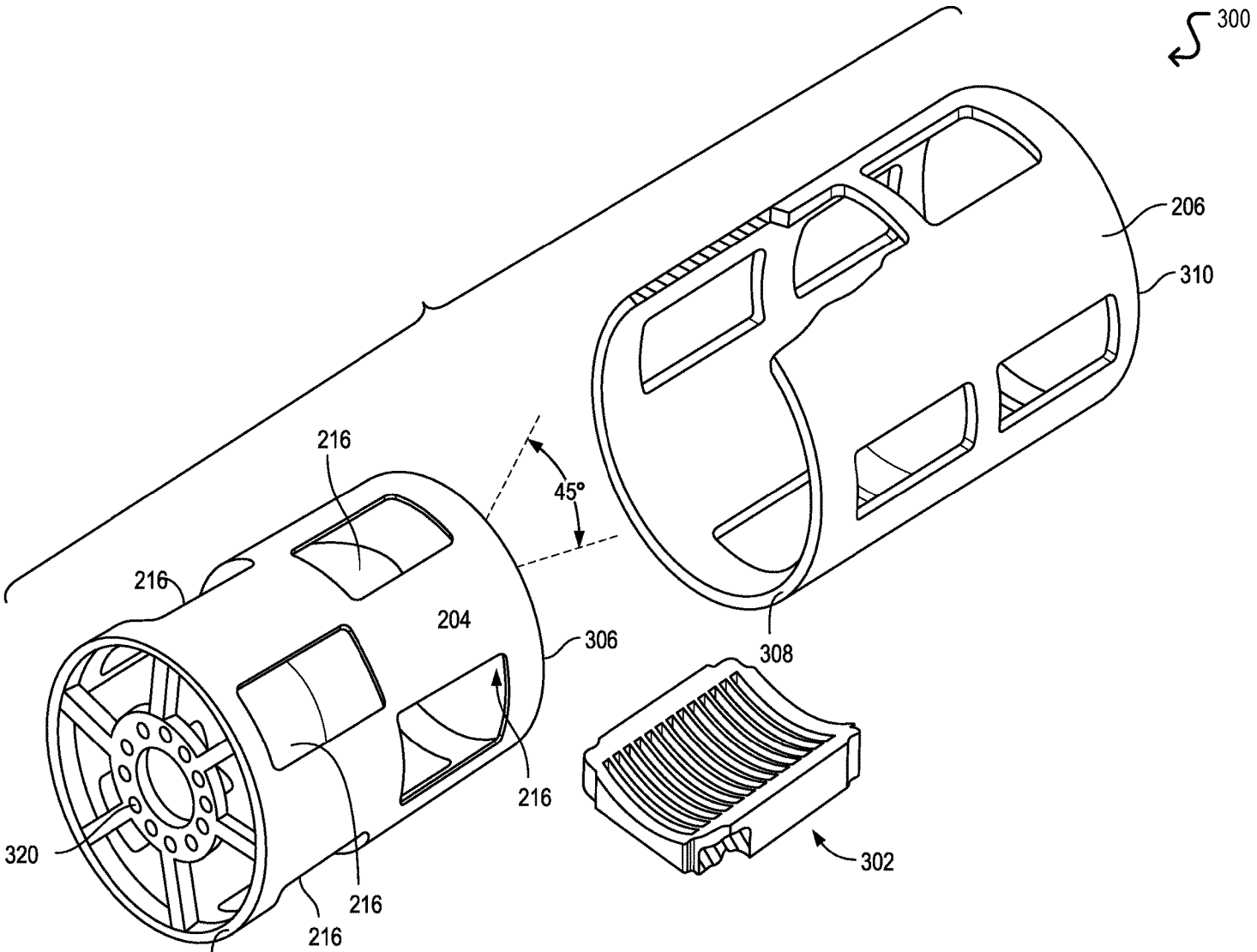
FIG. 3 (PRIOR ART)
FIG. 3 is an exploded view of the high pressure feeder of FIG. 1.

The low-pressure outlet port of the HPF 112 can be provided with a screen element (such as, e.g., the screen 302 shown in FIG. 3). The screen element retains the chips in the slurry within the feeder and allows some of the liquid in the slurry to pass out of the second end of the pocket, through the screen and out through the low pressure outlet port.

Chips 104 flow into a pocket(s) 216 of the pocket rotor 204 when the openings of the pocket align with the low-pressure inlet 210 and low-pressure outlet 116 of the HPF 112, e.g., when the pocket is vertical. The chips flow into the pocket from the chip chute 106 and mix with any remaining chips retained in the pocket by the screen element. The screen element prevents chips from flowing through the pocket and out the low-pressure outlet 116. As the pocket rotates 90 degrees, e.g., a quarter turn, the chips in the pocket are transported from a low-pressure flow to a high-pressure flow as the openings in the pocket align with the high-pressure inlet 122 and high-pressure outlet 208 of the HPF 112.

After the one-quarter revolution of the rotor, the first end of the pocket that was once in communication with the low-pressure inlet 210, is placed in communication with the high pressure outlet 208. The high-pressure outlet typically communicates with the inlet of a digester (e.g., a continuous or batch digester) via one or more conduits. At the same time, this quarter-turn rotation of the rotor also places the second end of the through-going pocket, which was just in communication with the low-pressure outlet, in communication with the high-pressure inlet 122. The high-pressure inlet 122 typically receives a flow of high-pressure circulation liquor from the pump (e.g., a high-pressure hydraulic pump) 118. The pressure of this circulation liquor typically ranges from about five to fifteen bar gauge, and is typically about seven to ten bar gauge. This high-pressure circulation liquor displaces the chip slurry from the through-going pocket and out of the high-pressure outlet of the HPF 112 (which in turn leads to the digester via conduit 114).

As the pocket rotor continues to rotate, the second end of the pocket that received the high-pressure fluid is placed in communication with the low-pressure inlet and receives another supply of chip slurry from the conduit connected to the low-pressure inlet. Similarly, the first end of the pocket is rotated into communication with the low-pressure outlet of the housing, having the screen element.

The above-described operation of the HPF 112 repeats such that during one complete revolution of the rotor, each through-going pocket receives and discharges two charges of the chip slurry. The rotor can include two (or another appropriate number such as four) through-going pockets such that the rotor is repeatedly receiving the chip slurry from the low-pressure inlet and discharging the chip slurry out of the high-pressure outlet. The ends of these pockets act as both an inlet and an outlet for the chip slurry depending upon the orientation of the rotor.

FIG. 3 is an exploded view of the HPF 112 of FIG. 1 and shows the pocket rotor, cylindrical chamber of the feeder housing, and screen plate of the HPF.

The pocket rotor 204 of the HPF 112 has a cylindrical shape with a slight taper extending from one end 304 of the rotor to the opposite end 306 of the rotor. The first end 44 of the rotor may have a smaller diameter than the opposite end of the rotor. The pocket rotor 204 fits in a tapered cylindrical chamber 206 (as also shown in FIG. 2) fixed to the housing.

The chamber 206 has a taper similar to the taper of the pocket rotor 204. A first end 308 of the chamber has a smaller diameter than an opposite end 310 of the chamber. The chamber 206 has openings 220 (shown in FIG. 2) that are aligned with the inlets and outlets of the housing of the HPF 112. The chip slurry flows through openings in the chamber 206 to enter the pockets 216 of the pocket rotor 204 and exit the pocket through openings in the chamber to the high-pressure outlet of the HPF. Similarly, high-pressure liquid passes through the openings in the chamber to enter the pockets of the rotor and to discharge through openings in the chamber to exit through the low-pressure outlet of the HPF 112.

A small tapered annular gap 222 (which is also referred to as a clearance) is formed between the rotor 204 and the chamber 206 when the rotor is inserted into the chamber. The gap 222 allows the rotor to rotate within the chamber.

The gap/clearance allows a small amount of liquid to serve as a lubricant between the pocket rotor and chamber. This liquid flows through the gap 222, such as from outlets in the pocket rotor 204. The liquid (also referred to as chip chute circulation liquor) drains through the screen 302 below the chamber and adjacent to the low-pressure outlet of the HPF 112. The liquid from the low-pressure outlet may be reused in, for example, the feed system 100.

If the gap is too wide, a pressure loss can occur in the high pressure fluid flow through the HPF 112, excessive liquid and fines may flow through the gap and accumulate in the housing, e.g., in end bells of the housing, and excessive liquid may leak through a low pressure outlet of the HPF, thus resulting in a loss of fluid pressure. On the other hand, if the gap is too narrow, metal-to-metal contact may occur between the rotor and chamber, and debris caught in the gap may etch grooves in the rotor or chamber.

The width of the gap is determined by the axial position of the pocket rotor 204 with respect to the chamber 206. Due to the complementary shapes of the pocket rotor 204 and chamber 206, the gap may be narrowed by moving the pocket rotor 204 axially towards the small diameter end of the chamber 206. Similarly, the gap 222 may be expanded by moving the rotor pocket axially towards the large diameter end of the chamber. During its axial movement, the pocket rotor 204 remains within the chamber 206.

The width of the gap 222 may be changed/adjusted by moving the rotor axially with respect to the housing. In some implementations, this gap adjustment is accomplished using a motor driven shaft 214 (as shown in FIG. 2 and as further described with reference to FIGS. 4A and 4B) that is connected to an end of the pocket rotor 204. The shaft 214 is axially aligned with the pocket rotor 204. A controller assembly 240 adjusts the axial position of the shaft and, thus, the axial position of the pocket rotor in the chamber of the housing (as further described with reference to FIGS. 4A and 4B).

In addition, liquid may collect in end bell chambers 230 of the housing that are adjacent opposite ends of the pocket rotor 204 and chamber 206. The liquid in the bell chambers 230 is preferably maintained under pressure to prevent additional flow, which may include fines, into the bell chambers. A conduit 232 for additional white liquor is connected to an inlet port to each of the bell chambers 230 at opposite ends of the housing for the HPF. The white liquor is provided under pressure from the conduit 232 (via conduit 122) to pressurize the liquid in the bell chambers and to prevent a flow of liquor and fines from the pocket rotor 204 into the bell chambers 230.

If the gap 222 is too large, excessive liquids and small particles (e.g., fiber fines, and other small debris, especially metal, rock and sand) may enter the gap through openings in the pocket rotor and may cause grooves to form in the outer surface of the pocket rotor 204 and the inner surface of the chamber 206. The fines and debris may flow through the gap and collect in interior bell chambers 230 and adjacent the axial ends of the pocket rotor 204. If excessive fines and debris collect in the bell chambers, the fines may resist the rotation of the rotor, causing the rotor components to wear and increase the power consumption of the high-pressure feeder 112.

Figure 4A:
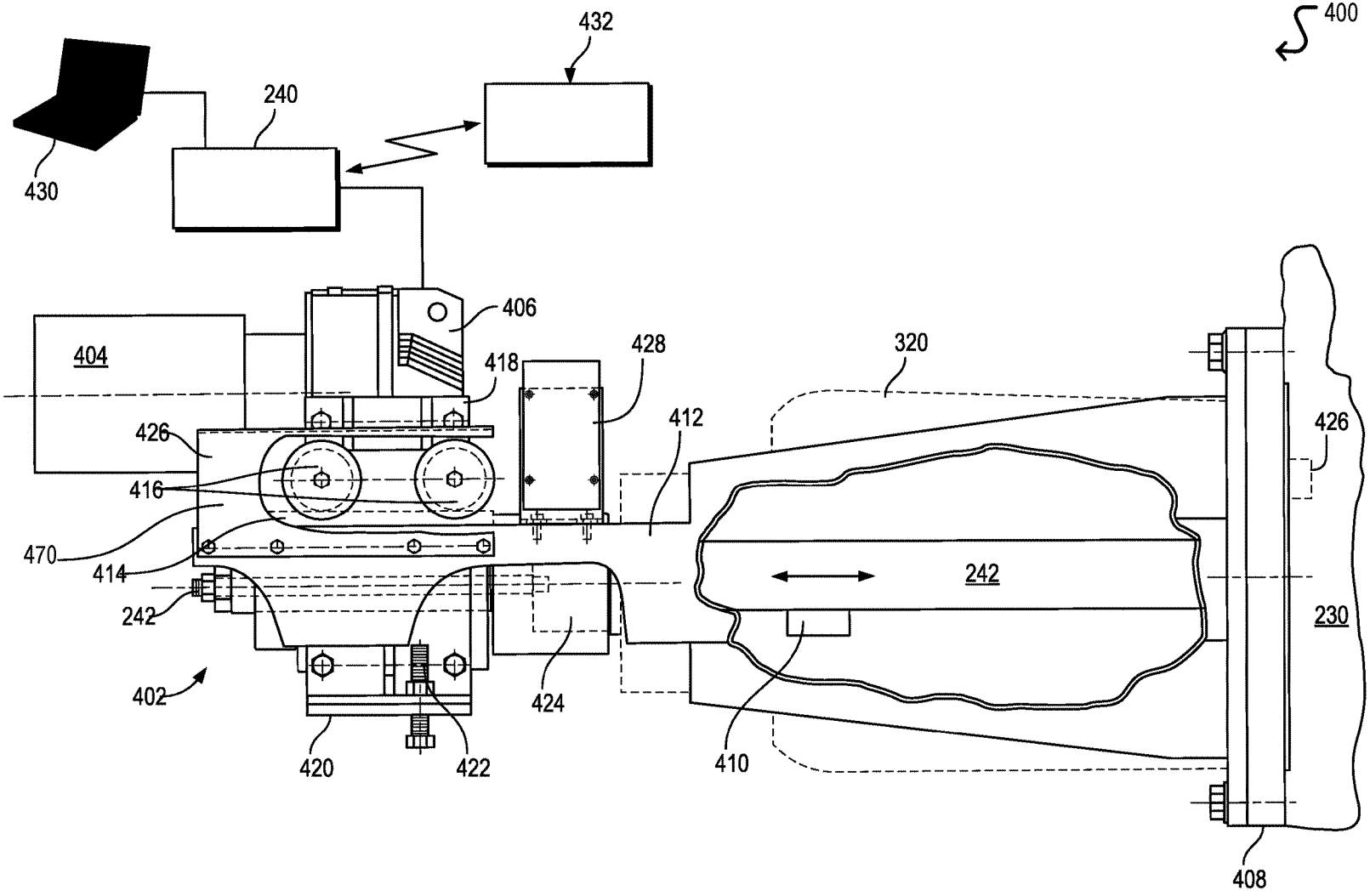
FIG. 4A shows a block diagram of the controller of FIG. 2 and its communication with components of the high pressure feeder of FIG. 1.

FIG. 4A shows a block diagram of the controller 240 of FIG. 2 and its communication with components of the HPF 112 that adjust the axial position of the pocket rotor.

The shaft 242 (as shown in FIG. 2) is contained within the housing 320, which in turn is included in the end bell housing 230 of the HPF 112. The controller assembly 402 includes an actuator for axially moving the shaft 242 and pocket rotor 204. The actuator includes a gear motor 404 and gearbox 406 that controls the axial position of the shaft 242 and hence the axial position of the pocket rotor.

The gearbox engages spiral threads on the shaft 242 to rotate the shaft. The rotation of the shaft 242 by the gearbox causes axial movement of the shaft and pocket rotor. The gear motor 404 receives commands from the computer controller 240 to turn the gearbox 406 by a prescribed angular amount. By commanding the gear motor 404 and gearbox 406, the computer controller 240 adjusts the axial position of the shaft and pocket rotor. The gear motor 404 tracks the rotation of the shaft by the gearbox 406 and provides signals of the rotation that enable the computer controller 240 to determine the current axial position of the shaft 242. In addition, the axial position of the shaft can be monitored or measured by a position sensor, such as a laser position sensor 410.

In some implementations, the controller assembly 402 is attached to the HPF 112 by a pair of brackets 412 that form cantilevered beams attached at one end to the housing of the HPF 112 and support a track 414 for the rollers 416 of the controller assembly 402. The beams of the brackets 412 may be hollow rectangular beams that extend horizontally. The controller assembly 402 may fit between the brackets. The roller wheels 416 of the controller assembly rest on the track 414 and enable the controller assembly 402 to move laterally along the tracks as the shaft 242 moves laterally with respect to the HPF 112. A pair of roller wheels 416 on each side of the controller assembly 402 are mounted on a frame 418 that is fixed to the controller assembly 402. The roller wheels may include an annular groove that rides on a ridge of the track 414.

A lower frame 420 is also fixed to each side of the controller assembly 402. The lower frame 420 includes a bolt 422, pin or other positioning device that prevents the roller wheels 416 from jumping upward and/or unintentionally coming off the track. The bolt 422 may be retracted to allow the controller assembly 402 to be installed on or removed from the HPF 112.

A generally horizontal frame 424 supports the gear motor 404, gearbox 406, and other components of the controller assembly. The horizontal frame is arranged between the brackets 412. A protective guard 470 may cover the rollers 416 and the track 414.

The computer controller 240 receives input signals indicative of the operating condition of the HPF and chip feed system. The input signals may be generated by sensors, flow meters, or other devices dispersed throughout the feed system 100. For example, the input signals may be provided by vibration or acoustical sensors 250 (as shown in FIG. 2). The HPF housing may include three or four (or another appropriate number of such sensors) on the housing of the HPF. Monitoring the vibration in or sounds emanating from the HPF provides an indication of whether metal-to-metal contact is occurring between the pocket rotor and chamber.

As another example, the input signals may be generated by the chip meter with the speed encoder 102 (as shown in FIG. 1) that measures the speed (e.g., revolutions per minute) at which the wood chips 102 are fed into the chip chute 106. As another example, the input signals may be generated by a power meter in the motor drive for the HPF. Such a meter can measure the electrical load of the HPF 112. As another example, the input signals may be generated by flow meters (e.g., magnetic flow meters), such as the flow meters (e.g., the flow meters that are shown and described with reference to FIG. 1). As another example, the input signals may be generated by pressure sensors 426 in the interior of the HPF 112, such as in the bell chambers 230. As another example, the input signals may be generated by a sensor 428 measuring the rotation and position of the drive shaft 242, and a sensor 252 (as shown in FIG. 2) measuring a fluid pressure in the gap 222. One of skill in the art may utilize one or more other sensors to measure the operational parameters/conditions of the HPF and/or the chip feed system.

The computer controller 240 monitors one or more of these signals to monitor the operating conditions of the HPF 112 and/or feed system 100. Based on these signals, the computer controller 240 may determine an appropriate size of the gap 222 between the pocket rotor 204 and the chamber 206 in the HPF 112 (as further described below and with reference to FIG. 5). The controller 240 uses the appropriate gap clearance to determine a desired axial position of the shaft 242. As described below, the controller 240 can utilize one or more of the above-described signals in determining the amount of fluid leakage through the gap 222 (as further described with reference to FIG. 5). Based on the amount of the fluid leakage through the gap 222, the controller 240 can either adjust (or cause the adjustment of) the gap 222 to either increase or decrease the leakage (as further described with reference to FIG. 5).

The computer controller 240 may include a display and user input device 430 that presents information to a human operator regarding the current operating condition of the HPF, and prompts for suggested changes to the axial position of the pocket rotor 204. For example, the displayed prompt may indicate that the pocket rotor 204 should be advanced inward or outward by a suggested distance, e.g., 2 mm, or, e.g., one or two predetermined step(s).

The computer controller 240 may have two modes: a manual mode and an automatic mode. In the manual mode, no automatic adjustments are made by the controller to the axial position of the pocket rotor. Rather, in this mode, the controller 240 may only display suggested actions by generating prompts to be presented on the display and for the benefit of human operators reading the display. The manual mode may allow an operator to enter commands in the user interface device 430 (or another device such as the remote computer 432) to cause the drive gears to advance or retract the shaft 242 and pocket rotor 204 by a distance specified by the operator. The commands may include, for example, commands to advance the pocket rotor (e.g., by one millimeter) or position the pocket rotor 204 at a specified axial position. A positioner motor receives commands from the computer controller 240 that indicate the rotation to be applied, to turn the gears and hence axially move the shaft 242 and the pocket rotor. For example, the computer controller 242 may command the positioned motor to turn the gears in the gear box 406 clockwise and counter-clockwise a certain rotational amount over a predefined period to move the pocket rotor in and out axially to flush fines from the bell chamber. In some implementations, if the operator moves the pocket rotor in too far in an axial direction and the controller 240 detects that the power load exceeds a predefined maximum load, the controller 240 can automatically override the human operator and retract the pocket rotor to increase the gap 222. In such implementations, the controller can also generate an alert (and/or trigger an alarm) that informs the operator that the maximum motor power load has been exceeded.

In the automatic mode, the computer controller 240 includes the features of the manual mode and an additional feature that allows the human operator to authorize the controller 240 to automatically execute certain operations, such as, for example, (1) causing the drive gears to automatically advance or retract the shaft 242 and pocket rotor 204 and (20 executing a "flush operation" during which the axial position of the pocket rotor is moved slightly in and out in a cyclical operation to flush fines out of the end bell 230 of the HPF housing. Fines are small fibrous particles from wood chips. Moreover, in the automatic mode, the display 430 prompts the operator to authorize the flush operation when the controller detects that an excessive amount of fines may be in the end bells.

The computer controller 240 may have a remote mode in which it automatically adjusts the axial position of the shaft and pocket rotor based on analysis performed by the controller 240 of signal inputs regarding the condition of the HPF 112 and/or the feed system 100 in general. In remote mode (but equally applicable to automatic and manual modes), the controller 240 may report the operation condition of the HPF 112 and/or the feed system generally to a remote computer 432 via the internet. In remote mode, the axial position of the pocket rotor may be adjusted based on commands entered by an operator at the remote computer 432.

In at least the remote mode, the computer controller 240 automatically turns the gears of the gear box 406 to move the shaft and pocket rotor and thereby adjust the clearance gap 222. The controller 240 may adjust the clearance based on the sensor signals that provide data regarding the operation of the HPF and algorithms stored in electronic memory of the controller 240. The algorithms convert the input signals from the sensors and commands from the operator into command signals for the gear motor 404 and gear box 406.

Figure 4B:
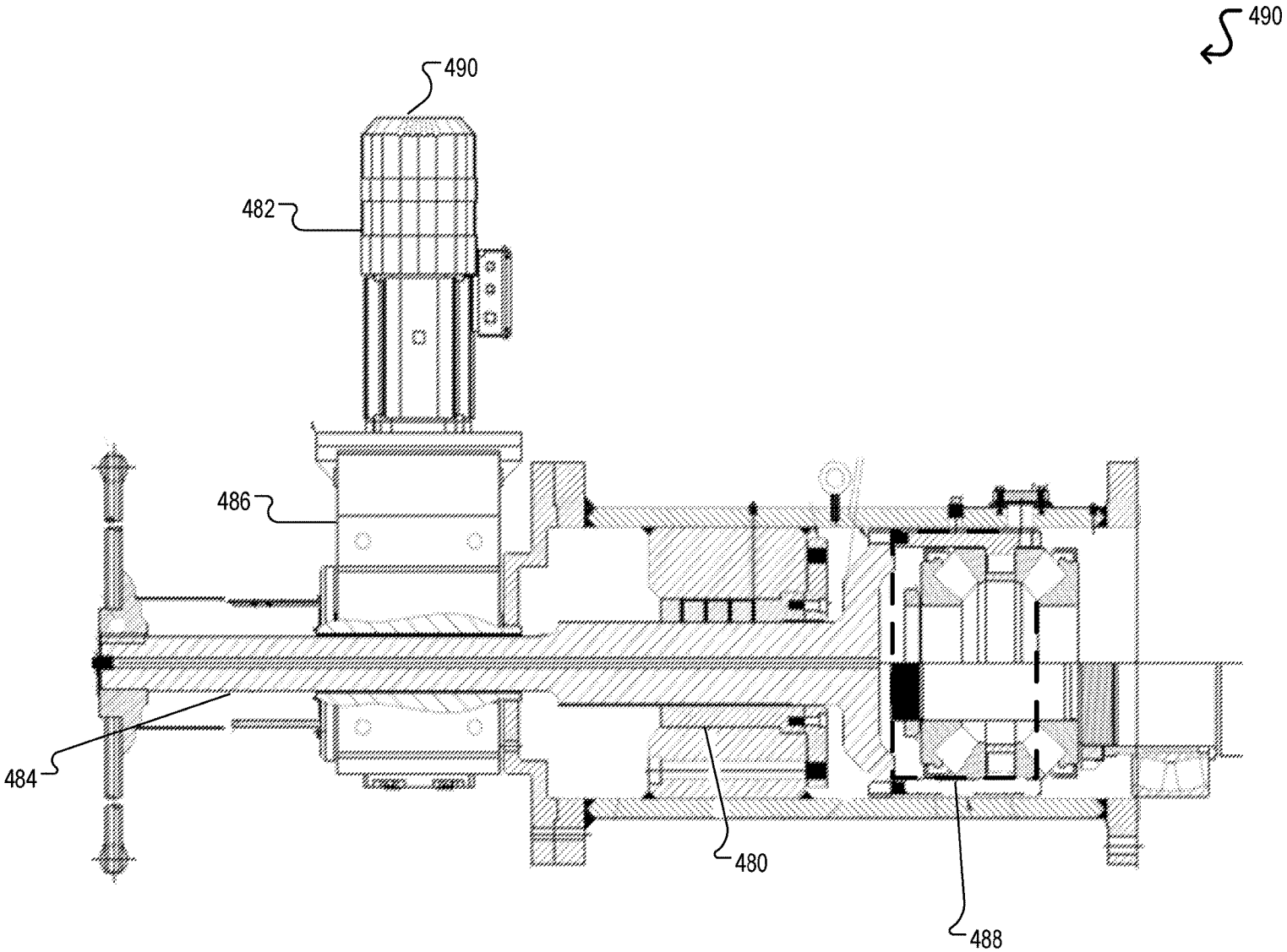
FIG. 4B shows a block diagram of an alternative controller assembly that can be used in connection with the controller of FIG. 2 in adjusting the HPF.

FIG. 4B shows a block diagram of an alternative controller assembly 490 that can be used in connection with the controller 240 of FIG. 2 in adjusting the HPF 112. The controller assembly 490 can be instead of the controller assembly 420 described with reference to FIG. 4A.

The controller assembly 490 can be attached at a fixed position to the HPF 112 (via the HPF's bearing housing). Because of its fixed nature, the controller assembly 490 thus, does not include any beams, rollers, brackets, wheels, tracks, or frames (as was the case with the controller assembly 402). The controller assembly 490 includes a motor 482 and a stationary gearbox 486 (which are collectively referred to as the gearmotor 490). The quill of the gearmotor 490 is splined, as is the spindle 484, which enables the spindle 484 to slide axially through the gearbox 486 upon being powered. The spindle 484 is splined through the gearbox 486 but has external threads through the bushing 480.

As the gearmotor 490 turns the spindle 484, the spindle assembly is moved axially, which causes the spindle 484 to turn the bearing housing 488. Simultaneously with the spindle 484 turning the bearing housing 488, the HPF rotor shaft assembly (as described above) turns independently.

Compared with the controller assembly 420, the controller assembly 490 may be safer because it has no open wheel pinch points, and can be more stable because the gearbox is now fixedly mounted to the HPF housing. Moreover, the controller assembly can be more easily retrofitted to existing HPFs (compared with the controller assembly 420) because they use many of the same parts as existing HPFs. Such retrofittability can enable a high safety factor during upset conditions, such as if and when one side of the HPF 112 becomes more pressurized than the other.

Figure 5:
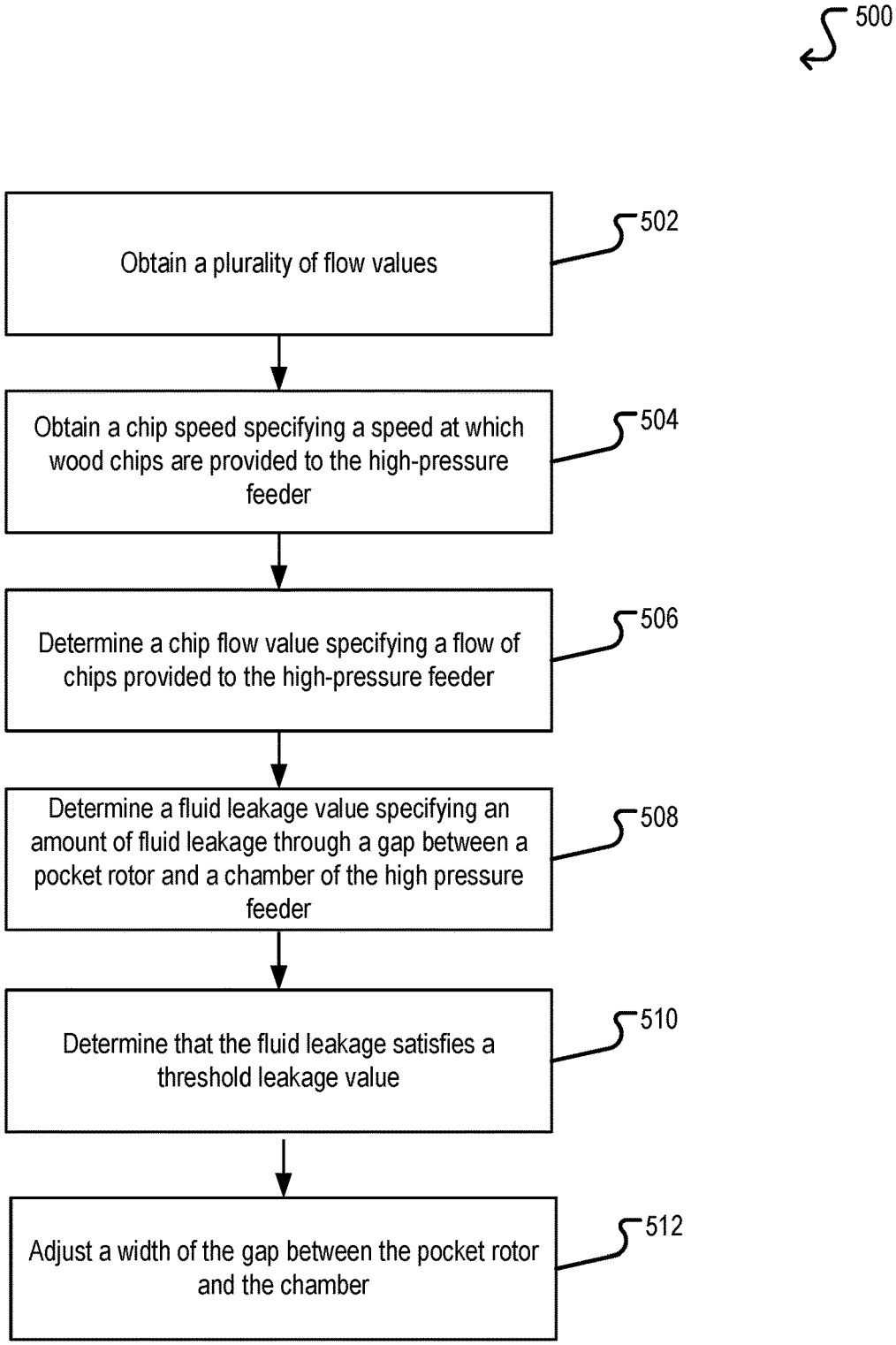
FIG. 5 is a flow diagram of an example process for adjusting the HPF of FIGS. 1-4 based on fluid leakage through a low-pressure outlet of the HPF.

FIG. 5 is a flow diagram of an example process 500 for adjusting the HPF 112 based on fluid leakage through a low-pressure outlet of the HPF 112. Operations of the process 500 can be implemented, for example, by the system components shown in FIGS. 1-4 (including FIGS. 4A and 4B), and/or one or more data processing apparatuses/computing devices (as described with reference to FIG. 6). For illustration purposes, the operations of process 500 are described below as being performed by the computer controller 240 in conjunction with the other components of the controller assembly 402 and the HPF 112. In some implementations, operation of the process 500 can also be implemented as instructions stored on a non-transitory computer readable medium, where execution of the instructions by one or more data processing apparatus cause the one or more computing devices/data processing apparatus to perform operations of the process 500.

The controller 240 obtains, from a plurality of flow meters, a plurality of flow values (at 502). The controller 240 receives (in response to a query to multiple flow meters or unprompted from the flow meters) multiple flow values. In some implementations, the controller 240 receives: (1) from the make-up liquor flow meter 136, a make-up liquor flow value specifying a flow of make-up liquor to a digester; (2) from the black liquor flow meter, a black liquor flow value specifying a flow of black liquor to the feed system 100, (3) from the white liquor flow meter 134, a white liquor flow value specifying a flow of white liquor to the feed system 100, (4) from the chip chute circulation flow meter 130, a chip chute circulation flow value specifying a flow of low pressure circulation liquor from a low-pressure outlet of the HPF 112, and (5) from the HPF purge flow meter 122, a high pressure feeder purge flow value specifying a flow of circulation liquor into a high-pressure inlet of the HPF 112. In some implementations, each of these flow values can be in units of gallons per minute (or another appropriate unit for measuring fluid flow). If the flow values are not all measured using the same measurement unit, the controller 240, upon receiving the respective flow values, converts one or more of them so that all the flow values are represented using the same measurement unit.

In some instances, any failure in one or more of the flow meters and/or the speed encoder (or other instrumentations) can prevent a flow determination, which in turn cause the leakage flow determination to be rendered incorrect or fail altogether. In such instances, other parameters/metrics can be used to estimate the respective flow values. For example, the flow values could be estimated using one or more of the following example parameters/metrics, such as valve position, HPF inlet pressure, HPF outlet pressure, and valve opening position and other valve characteristics.

The controller 240 obtains a chip speed specifying a speed at which wood chips are provided to the high-pressure feeder (at 504). In some implementations, in response to a query by the controller 240 to the chip speed encoder 102 (or without any query or other prompt), the controller 240 receives the chip speed from the chip speed encoder 102. The chip speed can be measured in revolutions per minute; however, another appropriate speed measurement unit can be used to record the chip speed.

The controller 240 determines a chip flow value specifying a flow of chips provided to the high-pressure feeder (at 506). In some implementations, the controller 240 determines the chip flow value using the chip speed obtained at operation 504. In such implementations, the controller 240 determines the chip flow value by scaling the chip meter speed by (1) a volumetric capacity of wood chips and (2) a displacement value. The volumetric capacity specifies a volume of wood chips that is provided to the HPF 112 at the particular chip meter speed. In some implementations, the capacity value is measured in units of cubic feet per RPM (i.e., $ft^3$/rpm); although another appropriate measurement unit such as gallons/rpm may be used as well. This capacity value is a constant value that is based on the design of the feed system 100. The displacement value specifies a rate at which air is displaced from the wood chips that is provided to the HPF 112. In some implementations, the displacement value is a constant value (e.g., a value of 0.4), which may be provided by an operator of the feed system 100.

In implementations where the chip speed is measured in RPM (revolutions per minute) and the volumetric capacity is measured in $ft^3$/rpm, the controller 240 determines the chip flow value in gallons per minute by multiplying the chip speed with the volumetric capacity and the displacement value, and then converting the resulting value to gallons per minute (e.g., by further multiplying the resulting value with a cubic feet-to-gallon conversion factor of 7.48).

The controller 240 determines a fluid leakage value specifying an amount of fluid leakage through a gap between a pocket rotor and a chamber of the HPF 112 (at 508). The controller 240 determines the fluid leakage value based on the flow values (obtained at operation 502) and the chip flow value (obtained at operation 506). In some implementations, the controller 240 determines the fluid leakage value by (1) computing a sum of the black liquor flow value, the white liquor flow value, the chip chute circulation flow value, and the high pressure feeder purge flow value, and (2) reducing the make-up liquor flow value by the computed sum to obtain the fluid leakage value (e.g., by computing a difference between the make-up liquor flow value and the computed sum of flow values).

The controller 240 determines whether the fluid leakage satisfies a threshold leakage value. The threshold leakage value can be a single number or a range. If the controller 240 determines that the fluid leakage satisfies (e.g., exceeds) the threshold leakage value (e.g., greater than a single number threshold or greater than the upper bound of the threshold range) (at 510), the controller 240 adjusts (e.g., reduces) the annular gap (e.g., width of the gap) between the pocket rotor 204 and the chamber 206 (at 512). On the other hand, if the controller 240 determines that the fluid leakage does not satisfy (e.g., is less than) the threshold leakage value (e.g., less than a single number threshold or less than the lower bound of the threshold range) (at 510), the controller 240 adjusts (e.g., increases) the annular the gap 222 between the pocket rotor 204 and the chamber 206.

In either case, to implement the appropriate adjustment, the controller 240 can maintain a lookup table that stores a correlation between leakage amounts and the corresponding width of the gap 222. In such implementations, the controller 240 uses the determined fluid leakage to lookup, via the lookup table, the corresponding gap width to apply. In alternative implementations, the controller 240 can use a set of stored rules that rely on multiple factors (e.g., current gap width, current axial position of the pocket rotor, current chamber position, desired fluid leakage amount) in determining the appropriate adjustment to the width of the gap 222.

Based on the determined adjustment to the annular gap 222, the controller 240 sends signals to the controller assembly 402 (e.g., a desired axial rotor position) to implement the determined adjustment to the width of the gap 222, e.g., by moving the pocket rotor axially with respect to the chamber, as described with reference to FIG. 4. Based on the received signals from the controller 240, the controller assembly 402 adjusts the annular gap 222 and in doing so, adjusts the fluid leakage through the gap 222 and the low-pressure outlet of the HPF 112.

Figure 6:
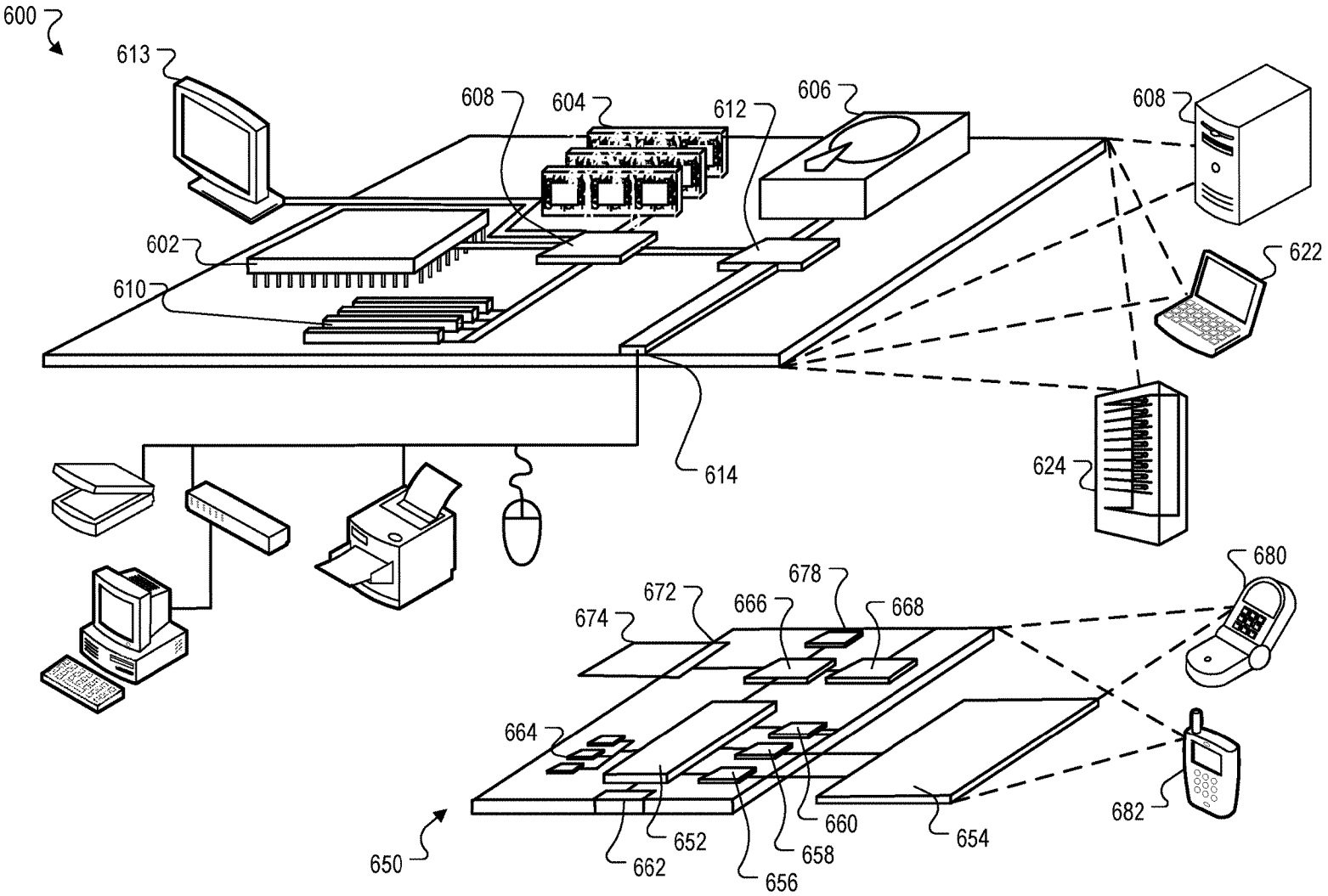
FIG. 6 is a block diagram of a computing system that can be used in connection with methods described in this specification.

FIG. 6 is a block diagram of computing devices 600, 650 that may be used to implement the systems and methods described in this document, either as a client or as a server or plurality of servers.

Computing device 600 is intended to represent various forms of digital computers, such as laptops, desktops, workstations, personal digital assistants, servers, blade servers, mainframes, and other appropriate computers. Computing device 650 is intended to represent various forms of mobile devices, such as personal digital assistants, cellular telephones, smartphones, smartwatches, head-worn devices, and other similar computing devices. The components shown here, their connections and relationships, and their functions, are meant to be exemplary only, and are not meant to limit implementations described and/or claimed in this document.

Computing device 600 includes a processor 602, memory 604, a storage device 606, a high-speed interface 608 connecting to memory 604 and high-speed expansion ports 610, and a low speed interface 612 connecting to low speed bus 614 and storage device 606. Each of the components 602-612 are interconnected using various buses, and may be mounted on a common motherboard or in other manners as appropriate. The processor 602 can process instructions for execution within the computing device 600, including instructions stored in the memory 604 or on the storage device 606 to display graphical information for a GUI on an external input/output device, such as display 616 coupled to high speed interface 608. In other implementations, multiple processors and/or multiple buses may be used, as appropriate, along with multiple memories and types of memory. Also, multiple computing devices 600 may be connected, with each device providing portions of the necessary operations (e.g., as a server bank, a group of blade servers, or a multi-processor system).

The memory 604 stores information within the computing device 600. In one implementation, the memory 604 is a computer-readable medium. In one implementation, the memory 604 is a volatile memory unit or units. In another implementation, the memory 604 is a non-volatile memory unit or units.

The storage device 606 is capable of providing mass storage for the computing device 600. In one implementation, the storage device 606 is a computer-readable medium. In various different implementations, the storage device 606 may be a hard disk device, an optical disk device, or a tape device, a flash memory or other similar solid state memory device, or an array of devices, including devices in a storage area network or other configurations. In one implementation, a computer program product is tangibly embodied in an information carrier. The computer program product contains instructions that, when executed, perform one or more methods, such as those described above. The information carrier is a computer- or machine-readable medium, such as the memory 604, the storage device 606, or memory on processor 602.

The high-speed controller 608 manages bandwidth-intensive operations for the computing device 600, while the low speed controller 612 manages lower bandwidth-intensive operations. Such allocation of duties is exemplary only. In one implementation, the high-speed controller 608 is coupled to memory 604, display 616 (e.g., through a graphics processor or accelerator), and to high-speed expansion ports 610, which may accept various expansion cards (not shown). In the implementation, low-speed controller 612 is coupled to storage device 606 and low-speed expansion port 614. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 600 may be implemented in a number of different forms, as shown in the figure. For example, it may be implemented as a standard server 620, or multiple times in a group of such servers. It may also be implemented as part of a rack server system 624. In addition, it may be implemented in a personal computer such as a laptop computer 622. Alternatively, components from computing device 600 may be combined with other components in a mobile device (not shown), such as device 650. Each of such devices may contain one or more of computing device 600, 650, and an entire system may be made up of multiple computing devices 600, 650 communicating with each other.

Computing device 650 includes a processor 652, memory 664, an input/output device such as a display 654, a communication interface 666, and a transceiver 668, among other components. The device 650 may also be provided with a storage device, such as a microdrive or other device, to provide additional storage. Each of the components 650-668 are interconnected using various buses, and several of the components may be mounted on a common motherboard or in other manners as appropriate.

The processor 652 can process instructions for execution within the computing device 650, including instructions stored in the memory 664. The processor may also include separate analog and digital processors. The processor may provide, for example, for coordination of the other components of the device 650, such as control of user interfaces, applications run by device 650, and wireless communication by device 650.

Processor 652 may communicate with a user through control interface 558 and display interface 656 coupled to a display 654. The display 654 may be, for example, a TFT LCD display or an OLED display, or other appropriate display technology. The display interface 656 may comprise appropriate circuitry for driving the display 654 to present graphical and other information to a user. The control interface 658 may receive commands from a user and convert them for submission to the processor 652. In addition, an external interface 662 may be provided in communication with processor 652, to enable near area communication of device 650 with other devices. External interface 662 may provide, for example, for wired communication (e.g., via a docking procedure) or for wireless communication (e.g., via Bluetooth or other such technologies).

The memory 664 stores information within the computing device 550. In one implementation, the memory 664 is a computer-readable medium. In one implementation, the memory 664 is a volatile memory unit or units. In another implementation, the memory 664 is a non-volatile memory unit or units. Expansion memory 674 may also be provided and connected to device 650 through expansion interface 672, which may include, for example, a SIMM card interface. Such expansion memory 674 may provide extra storage space for device 650, or may also store applications or other information for device 650. Specifically, expansion memory 674 may include instructions to carry out or supplement the processes described above, and may include secure information also. Thus, for example, expansion memory 674 may be provided as a security module for device 650, and may be programmed with instructions that permit secure use of device 650. In addition, secure applications may be provided via the SIMM cards, along with additional information, such as placing identifying information on the SIMM card in a non-hackable manner.

The memory may include for example, flash memory and/or MRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 664, expansion memory 674, or memory on processor 652.

Device 650 may communicate wirelessly through communication interface 666, which may include digital signal processing circuitry where necessary. Communication interface 666 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 668. In addition, short-range communication may occur, such as using a Bluetooth, Wi-Fi, or other such transceiver (not shown). In addition, GPS receiver module 670 may provide additional wireless data to device 650, which may be used as appropriate by applications running on device 650.

Device 650 may also communicate audibly using audio codec 660, which may receive spoken information from a user and convert it to usable digital information. Audio codec 660 may likewise generate audible sound for a user, such as through a speaker, e.g., in a handset of device 650. Such sound may include sound from voice telephone calls, may include recorded sound (e.g., voice messages, music files, etc.) and may also include sound generated by applications operating on device 650.

The computing device 650 may be implemented in a number of different forms, as shown in the figure. For example, it may be implemented as a cellular telephone 680. It may also be implemented as part of a smartphone 682, personal digital assistant, or other similar mobile device.

Various implementations of the systems and techniques described here can be realized in digital electronic circuitry, integrated circuitry, specially designed ASICs, computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs, also known as programs, software, software applications or code, include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device, e.g., magnetic discs, optical disks, memory, Programmable Logic Devices (PLDs) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

The systems and techniques described here can be implemented in a computing system that includes a back end component, e.g., as a data server, or that includes a middleware component such as an application server, or that includes a front end component such as a client computer having a graphical user interface or a Web browser through which a user can interact with an implementation of the systems and techniques described here, or any combination of such back end, middleware, or front end components. The components of the system can be interconnected by any form or medium of digital data communication such as, a communication network. Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

As used in this specification, the term "module" is intended to include, but is not limited to, one or more computers configured to execute one or more software programs that include program code that causes a processing unit(s)/device(s) of the computer to execute one or more functions. The term "computer" is intended to include any data processing or computing devices/systems, such as a desktop computer, a laptop computer, a mainframe computer, a personal digital assistant, a server, a handheld device, a smartphone, a tablet computer, an electronic reader, or any other electronic device able to process data.

A number of embodiments have been described. Nevertheless, it will be understood that various modifications may be made without departing from the spirit and scope of the invention. Accordingly, other embodiments are within the scope of the following claims. While this specification contains many specific implementation details, these should not be construed as limitations on the scope of what may be claimed, but rather as descriptions of features that may be specific to particular embodiments. Certain features that are described in this specification in the context of separate embodiments can also be implemented in combination in a single embodiment.

Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the subject matter have been described. Other embodiments are within the scope of the following claims. For example, the actions recited in the claims can be performed in a different order and still achieve desirable results. As one example, some processes depicted in the accompanying figures do not necessarily require the particular order shown, or sequential order, to achieve desirable results.

The invention claimed is:

1. A method for controlling fluid leakage in a high pressure feeder of a feed system, comprising:

obtaining, from a plurality of flow meters, a plurality of flow values, including (1) a make-up liquor flow value specifying a flow of make-up liquor to a digester, (2) a black liquor flow value specifying a flow of black liquor to the feed system, (3) a white liquor flow value specifying a flow of white liquor to the feed system, (4) a chip chute circulation flow value specifying a flow of low pressure circulation liquor from a low-pressure outlet of the high pressure feeder, and (5) a high pressure feeder purge flow value specifying a flow of white liquor into a high-pressure inlet of the high pressure feeder;

obtaining, using a chip meter speed encoder, a chip meter speed specifying a speed at which wood chips are provided to the high-pressure feeder;

determining, using the chip speed, a chip flow value specifying a flow of chips provided to the high-pressure feeder comprising scaling the chip meter speed by (1) a volumetric capacity of wood chips specifying a volume of wood chips that are provided to the high pressure feeder at the chip speed and (2) a displacement value specifying a rate at which air is displaced from the wood chips provided to the high pressure feeder;

determining, using the plurality of flow values and the chip flow value, a fluid leakage value specifying an amount of fluid leakage through a gap between a pocket rotor and a housing of the high pressure feeder;

determining that the fluid leakage satisfies a threshold leakage value; and in response to determining that the fluid leakage satisfies the threshold leakage value, adjusting an annular gap between the pocket rotor and the housing.

2. The method of claim 1, wherein determining, using the plurality of flow values and the chip flow value, a fluid leakage value, comprises:

computing a sum of the black liquor flow value, the white liquor flow value, the chip chute circulation flow value, and the high pressure feeder purge flow value; and reducing the make-up liquor flow value by the computed sum to obtain the fluid leakage value.

3. The method of claim 1, wherein adjusting the annular gap between the pocket rotor and the housing includes moving the pocket rotor into the housing.

4. The method of claim 3, wherein the pocket rotor is coaxial with the housing, and wherein moving the pocket rotor into the housing includes moving the pocket rotor axially with respect to the housing.

5. A system comprising:

one or more memory devices storing instructions; and one or more data processing apparatus that are configured to interact with the one or more memory devices, and upon execution of the instructions, perform operations of controlling fluid leakage in a high pressure feeder of a feed system, comprising including:

receiving, from a client device, a content request;

obtaining, from a plurality of flow meters, a plurality of flow values, including (1) a make-up liquor flow value specifying a flow of make-up liquor to a digester, (2) a black liquor flow value specifying a flow of black liquor to the feed system, (3) a white liquor flow value specifying a flow of white liquor to the feed system, (4) a chip chute circulation flow value specifying a flow of low pressure circulation liquor from a low-pressure outlet of the high pressure feeder, and (5) a high pressure feeder purge flow value specifying a flow of white liquor into a high-pressure inlet of the high pressure feeder;

obtaining, using a chip meter speed encoder, a chip meter speed specifying a speed at which wood chips are provided to the high-pressure feeder;

determining, using the chip speed, a chip flow value specifying a flow of chips provided to the high-pressure feeder, comprising scaling the chip meter speed by (1) a volumetric capacity of wood chips specifying a volume of wood chips that are provided to the high pressure feeder at the chip meter speed and (2) a displacement value specifying a rate at which air is displaced from the wood chips provided to the high pressure feeder;

determining, using the plurality of flow values and the chip flow value, a fluid leakage value specifying an amount of fluid leakage through a gap between a pocket rotor and a housing of the high pressure feeder;

determining that the fluid leakage satisfies a threshold leakage value; and in response to determining that the fluid leakage satisfies the threshold leakage value, adjusting an annular gap between the pocket rotor and the housing.

6. The system of claim 5, wherein determining, using the plurality of flow values and the chip flow value, a fluid leakage value, comprises:

computing a sum of the black liquor flow value, the white liquor flow value, the chip chute circulation flow value, and the high pressure feeder purge flow value; and reducing the make-up liquor flow value by the computed sum to obtain the fluid leakage value.

7. The system of claim 5, wherein adjusting the annular gap between the pocket rotor and the housing includes moving the pocket rotor into the housing.

8. The system of claim 7, wherein the pocket rotor is coaxial with the housing, and wherein moving the pocket rotor into the housing includes moving the pocket rotor axially with respect to the housing.

9. A non-transitory computer readable medium storing instructions that, when executed by one or more data processing apparatus, cause the one or more data processing apparatus to perform operations of controlling fluid leakage in a high pressure feeder of a feed system, comprising:

obtaining, from a plurality of flow meters, a plurality of flow values, including (1) a make-up liquor flow value specifying a flow of make-up liquor to a digester, (2) a black liquor flow value specifying a flow of black liquor to the feed system, (3) a white liquor flow value specifying a flow of white liquor to the feed system, (4) a chip chute circulation flow value specifying a flow of low pressure circulation liquor from a low-pressure outlet of the high pressure feeder, and (5) a high pressure feeder purge flow value specifying a flow of white liquor into a high-pressure inlet of the high pressure feeder;

obtaining, using a chip meter speed encoder, a chip meter speed specifying a speed at which wood chips are provided to the high-pressure feeder;

determining, using the chip meter speed, a chip flow value specifying a flow of chips provided to the high-pressure feeder, comprising scaling the chip meter speed by (1) a volumetric capacity of wood chips specifying a volume of wood chips that are provided to the high pressure feeder at the chip meter speed and (2) a displacement value specifying a rate at which air is displaced from the wood chips provided to the high pressure feeder;

determining, using the plurality of flow values and the chip flow value, a fluid leakage value specifying an amount of fluid leakage through a gap between a pocket rotor and a housing of the high pressure feeder;

determining that the fluid leakage satisfies a threshold leakage value; and in response to determining that the fluid leakage satisfies the threshold leakage value, adjusting an annular gap between the pocket rotor and the housing.

10. The non-transitory computer readable medium of claim 9, wherein determining, using the plurality of flow values and the chip flow value, a fluid leakage value, comprises:

computing a sum of the black liquor flow value, the white liquor flow value, the chip chute circulation flow value, and the high pressure feeder purge flow value; and reducing the make-up liquor flow value by the computed sum to obtain the fluid leakage value.

11. The non-transitory computer readable medium of claim 9, wherein adjusting the annular gap between the pocket rotor and the housing includes moving the pocket rotor into the housing.

12. The non-transitory computer readable medium of claim 11, wherein the pocket rotor is coaxial with the housing, and wherein moving the pocket rotor into the housing includes moving the pocket rotor axially with respect to the housing.

* * * * *